US005621925A

United States Patent [19]

Bastenhof

[11] Patent Number: 5,621,925

[45] Date of Patent: Apr. 22, 1997

[54] POOL OR WATER TANK, SUCH AS A SWIMMING POOL, PROVIDED WITH MEANS GENERATING WAVES

[76] Inventor: Dirk Bastenhof, Edelvalk 32, NL-3905 RB Veenendaal, Netherlands

[21] Appl. No.: 397,970

[22] Filed: Mar. 3, 1995

[51] Int. Cl.[6] ..... E04H 3/16

[52] U.S. Cl. ..... 4/491; 405/79

[58] Field of Search ..... 4/491; 405/79

[56] References Cited

U.S. PATENT DOCUMENTS

| | | | |
|---|---|---|---|
| 3,350,724 | 11/1967 | Leigh | 4/491 |
| 3,605,131 | 9/1971 | Brazel et al. | 4/491 |
| 4,062,192 | 12/1977 | Biewer | 4/491 X |
| 4,276,664 | 7/1981 | Baker | 4/491 |
| 4,515,500 | 5/1985 | Bastenhof | 4/491 X |
| 4,522,535 | 6/1985 | Bastenhof | 4/491 X |
| 4,558,474 | 12/1985 | Bastenhof | 4/491 |
| 5,219,315 | 6/1993 | Fuller et al. | 472/59 |

FOREIGN PATENT DOCUMENTS

| | | | |
|---|---|---|---|
| 2693225 | 1/1994 | France | 405/79 |

*Primary Examiner*—Charles E. Phillips
*Attorney, Agent, or Firm*—Heslin & Rothenberg, PC

[57] ABSTRACT

A pool or water tank is provided with means for generating waves. Said means comprise one or more pipes (2), each of which is connected, at least at both ends, via a hole (8) in the wall of the pool or tank, to the pool or tank, wherein a piston or disc (5) which essentially closes off the cross-section of the pipe is fitted in one section of each of the pipes and a power source (6) is present in order to move the piston or disc backwards and forwards.

9 Claims, 2 Drawing Sheets

POOL OR WATER TANK, SUCH AS A SWIMMING POOL, PROVIDED WITH MEANS GENERATING WAVES

The invention relates to a pool or water tank provided with means for generating waves.

Various methods are known for generating waves in swimming pools or water tanks for fish or mammals. One of said methods comprises supplying compressed air in turn to chambers which are closed at the top and at the bottom protrude into the water in the pool or tank. If the compressed air is introduced into the various chambers at the natural frequency of the pool, this method requires relatively little energy, but the major drawback is that the tank or swimming pool has to have an adapted, relatively expensive design.

In the case of a second known method, a ball which has a weight which is movable up and down therein floats in the middle of the tank. A ball of this type takes up a relatively large amount of space and must be able to be suspended from the ceiling by a hoist construction. Moreover, a long electric cable to the ball is needed underwater, the length of said cable being subject to regulations.

Furthermore, it is known to move part of the floor of a swimming pool. This involves an expensive structural facility which is usually unsuitable for existing pools or tanks.

The aim of the invention is to overcome the drawbacks of known pools or water tanks which have wave mechanisms and to provide a pool or water tank, indicated in the preamble, for which the means for generating waves are simple and relatively inexpensive and can be installed in existing pools or tanks without special structural facilities (apart from possibly raising the height of the walls of the pool or tank). Moreover, the wave facilities must not give rise to obstacles for swimmers and there must be no cables or leads present in the pool or tank.

According to the invention, the pool or water tank provided with means for generating waves is characterised in that said means comprise one or more pipes, each of which is connected, at least at both ends, via a hole in the wall of the pool or tank, to the pool or tank, wherein a piston or disc which essentially closes off the cross-section of the pipe is fitted in one section of each of the pipes and a power source is present in order to move the piston or disc backwards and forwards.

DE-A-2811623 describes a swimming pool wherein a niche filled with water adjoins one of the sides of the swimming pool, is in open communication with the swimming pool and is divided into three chambers by means of two partitions. The two partitions are each connected by means of a rod to a piston which is movable in a hydraulic cylinder. Waves can be generated in the swimming pool by moving the two partitions by means of the pistons. This construction requires expensive structural facilities and is not suitable for adding to an existing swimming pool as a recreational element in a simple manner.

Preferably, the length of the pipes corresponds to at most half of a resonance wavelength of the water in the pool or tank.

In practice, each pipe will be provided on either side of the central section, in which said piston or disc is movable, with two or more channels connected to a hole in the wall of the swimming pool.

The cross-sectional area of the channels will have to be greatest at locations where the amplitude of the wave is greatest, and vice versa. Therefore, the cross-sectional area of the channels will be greatest at the ends of a pipe and that of the channels at the side of said means will be smallest and the cross-sectional area of the channels will decrease from the largest channel to the smallest channel.

If various pipes are used, the power sources will operate in phase with one another but in opposing directions of flow.

The invention also relates to a wave installation to be used in the abovementioned pool or water tank.

The invention will now be explained in more detail with reference to the figures.

Figure 1:
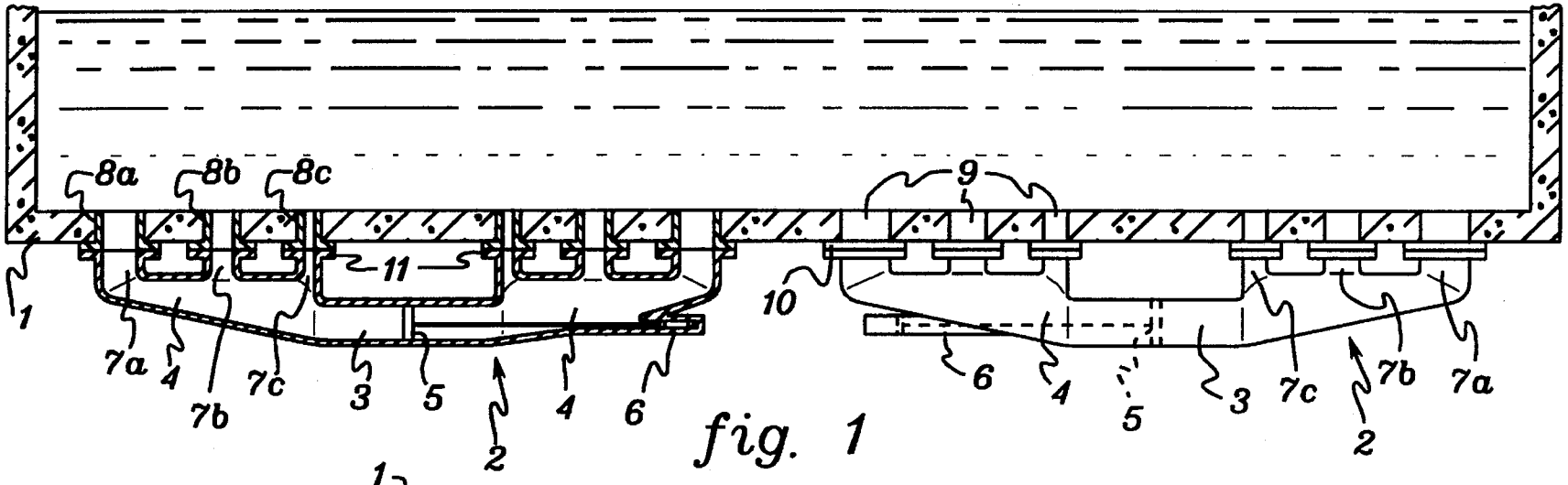
FIG. 1 shows a top view of part of the pool or water tank.

The walls of the wave pool or tank shown are indicated by 1. Two wave installations, each consisting of a pipe 2 having a central section 3 and two connecting sections 4 fitted on either side thereof, are installed on one side wall. A piston or disc 5, which essentially closes off the cross-sectional surface area and can be moved backwards and forwards by means of a piston rod of a pneumatic cylinder 6, is fitted inside the central section. The connecting sections 4 each have three inlet and outlet channels 7*a*, 7*b*, 7*c*, which are connected by flange connections to openings 8*a*, 8*b*, 8*c* in the side wall of the pool or tank.

Figure 3:
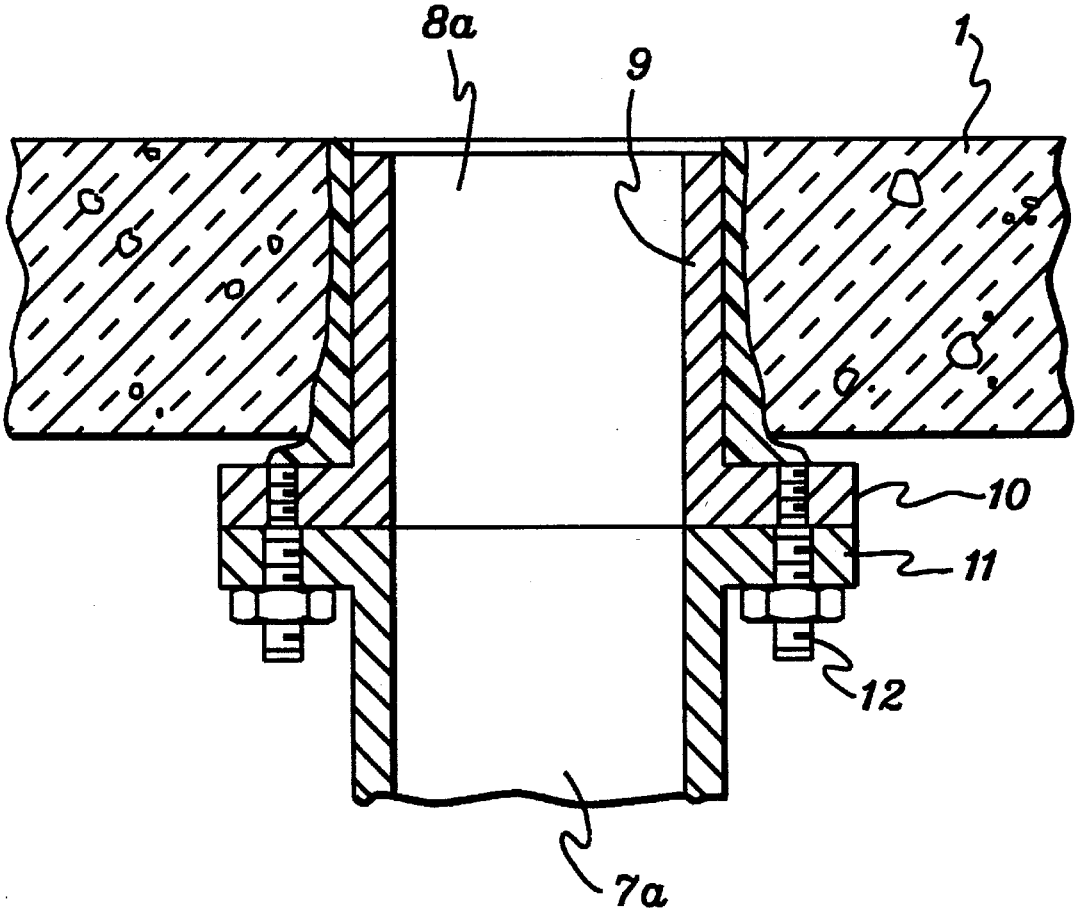
FIG. 3 shows a cross-section of a possible connection of an orifice of a pipe opening into an opening in the side wall of the pool or tank.

FIG. 3 shows the flange connection between a channel 7*a* and the side wall of the pool or tank. A pipe 9 is fixed by means of resin in the opening 8*a* to provide a seal. Said pipe has a flange 10, which is fixed by means of bolts 11 to a flange 12 of the channel 7*a*.

Figure 2:
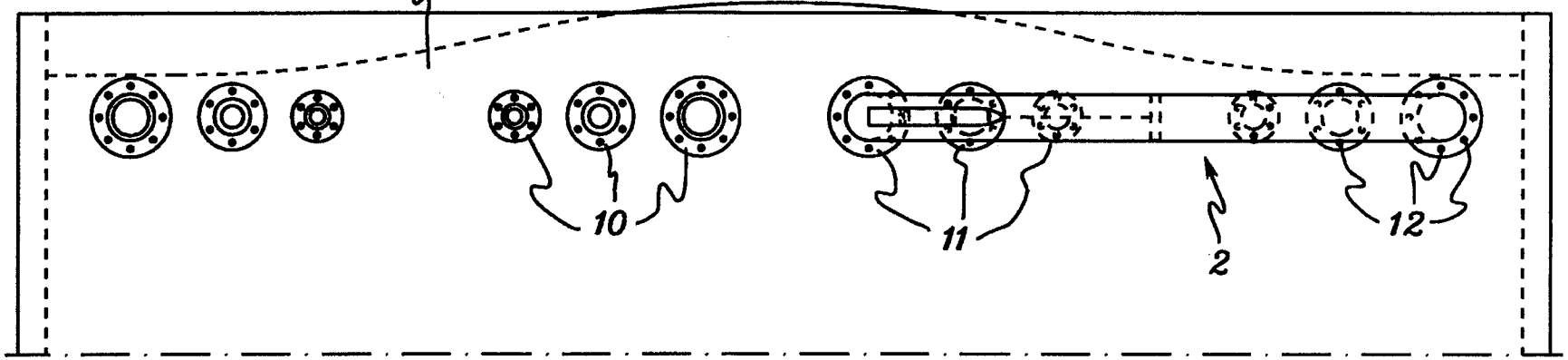
FIG. 2 shows a side view of the pool or water tank according to FIG. 1.

The length of a pipe 2 corresponds to at most half the resonance wavelength of the pool or tank. The two pipes shown generate waves which have twice a half resonance wavelength. The one pipe operates in the same phase but in the reverse direction of flow to the preceding pipe. The shape of the waves is shown by a broken line in FIG. 2.

The channels 7*a* and the openings 8*a* at the ends of a pipe 2 have a larger cross-section than the channels 7*b* and openings 8*b*, which, in turn, have a larger cross-section than the channels 7*c* and openings 8*c*. Consequently, the size of the cross-section follows the size of the wave amplitude.

Of course, the first impulse will take a great deal of power, but as the wavelength of the generated wave follows the resonance wavelength of the pool or water tank, it becomes increasingly easier.

The installation according to the invention has considerable advantages. It is easy to install. No structural facilities are needed for wave generation. It may be necessary to raise the height of the sides of the pool or tank, or the water level could be lowered. The apparatus can be fixed to the outside of existing pools or tanks by simply drilling a few holes in the wall of the pool or tank. The apparatus does not constitute any obstacles for the swimmer and there are no cables or leads through the area. It is very suitable for use in tanks containing mammals or fish and produces no noise.

I claim:

1. In combination, a wave generating device and a swimming pool or water tank comprising:

at least one pipe having first and second ends connected through a wall of the pool or tank so as to be in communication with the interior thereof below the water level; and means located in said at least one pipe for selectively moving water back and forth axially in said at least one pipe so as to expel water from said first end into the pool or tank while intaking water from the pool or tank into said second end and subsequently to expel water from said second end while intaking water from the pool or tank at said first end so as to generate waves in said pool or tank.

2. The combination of claim 1 wherein said water moving means comprises a piston slideably and sealingly fitted within said pipe and a motive power source operatively connected to the piston for causing reciprocating movement of the piston axially within the pipe.

3. The combination of claim 2 wherein the first and second ends are positioned on opposed sides of a length of said pipe in which said piston reciprocates.

4. The combination of claim 2 comprising first and second pipes having respective first and second pistons wherein the pistons oscillate in synchronized motion with the first piston moving lengthwise through said first pipe in a direction opposite that of the second piston in said second pipe.

5. The combination of claim 1 wherein the distance along the wall encompassed by the ends is at most half of the resonance wave length of the water in the pool or tank and the ends lie in a horizontal plane.

6. The combination of claim 5 wherein said first and second ends each comprise a corresponding plurality of channels for individual connection through the wall of the pool in said plane.

7. The combination of claim 6 wherein the channels closest the midpoint of said pipe are smallest in cross-sectional area and the channels furthest from the midpoint of said pipe are largest in cross-sectional area.

8. The combination of claim 7 wherein the corresponding channels are symmetrically spaced relative to the midpoint of said pipe.

9. The combination of claim 1 comprising a pair of pipes wherein the water movement in each pipe is synchronized with that in the other.

* * * * *